US005898093A

United States Patent [19]

Vos

[11] Patent Number: 5,898,093

[45] Date of Patent: Apr. 27, 1999

[54] TREATMENT PROCESS FOR CONTAMINATED WASTE

[75] Inventor: Rikkert J. Vos, Richmond, Canada

[73] Assignee: Solucorp Industries, Ltd., West Nyack, N.Y., NY

[21] Appl. No.: 08/823,627

[22] Filed: Mar. 25, 1997

Related U.S. Application Data

[63] Continuation of application No. 08/339,784, Nov. 15, 1994, abandoned.

[51] Int. Cl.[6] ..... A62D 3/00

[52] U.S. Cl. ..... 588/236; 588/231; 588/251; 588/256; 405/128; 405/263

[58] Field of Search ..... 405/128, 129, 405/263; 588/231, 236, 251, 252, 256, 257

[56] References Cited

U.S. PATENT DOCUMENTS

| | | | |
|---|---|---|---|
| 3,817,859 | 6/1974 | Tate | 210/57 |
| 4,354,942 | 10/1982 | Kaczur et al. | 588/256 |
| 4,364,773 | 12/1982 | Veronneau et al. | 588/236 |
| 4,629,509 | 12/1986 | O'Hara et al. | 405/128 |
| 4,687,373 | 8/1987 | Falk et al. | 405/128 |
| 4,737,356 | 4/1988 | O'Hara et al. | 423/659 |
| 5,037,479 | 8/1991 | Stanforth | 588/236 |
| 5,139,365 | 8/1992 | Chesner | 405/129 |
| 5,162,600 | 11/1992 | Cody et al. | 405/263 |
| 5,193,936 | 3/1993 | Pal et al. | 405/128 |
| 5,202,033 | 4/1993 | Stanforth et al. | 588/236 |
| 5,234,485 | 8/1993 | Bolsing | 405/263 |
| 5,397,478 | 3/1995 | Pal et al. | 588/256 |
| 5,413,616 | 5/1995 | Bolsing | 405/263 |
| 5,512,702 | 4/1996 | Ryan et al. | 588/256 |
| 5,527,982 | 6/1996 | Pal et al. | 588/256 |
| 5,536,899 | 7/1996 | Forrester | 588/260 |
| 5,569,155 | 10/1996 | Pal et al. | 588/256 |
| 5,637,355 | 6/1997 | Stanforth et al. | 588/236 |

FOREIGN PATENT DOCUMENTS

| | | |
|---|---|---|
| 0584015 | 2/1994 | European Pat. Off. . |
| 0584015 | 2/1998 | European Pat. Off. . |
| 3918292 | 4/1990 | Germany . |
| 9322242 | 11/1993 | WIPO . |

*Primary Examiner*—Gary P. Straub
*Attorney, Agent, or Firm*—Coudert Brothers

[57] ABSTRACT

A process for treating contaminated waste to stabilize environmentally harmful heavy metal. The contaminated waste is contacted with a mixture of (i) inorganic sulfide, (ii) calcium phosphate to prevent oxidation of the sulfide and (iii) calcium carbonate, the last acting as a base. Water is added to enhance mass transfer during the mixing. The calcium carbonate may be mixed with calcium oxide, to provide an additional base.

11 Claims, No Drawings

TREATMENT PROCESS FOR CONTAMINATED WASTE

This application is a continuation of application Ser. No. 08/339,784 filed Nov. 15, 1994 , now abandoned.

FIELD OF THE INVENTION

This invention relates to a process to treat contaminated waste, particularly waste containing toxic metals, to render the toxic metals harmless to the environment.

DESCRIPTION OF THE PRIOR ART

The treating of heavy metals in waste such as soil, ash, sludge, baghouse dust and sediments, to stabilize the metals, is of increasing importance. These metals can become mobile, enter the ground water and cause environmental damage to ecosystems. For example, it is of significance where land is rezoned from industrial to recreational or housing use. A particular concern is where the soil, either from natural causes or because of industry previously carried out on the site, contains elements toxic to the environment. These elements can be leached out, become mobile, and enter the water table where they are spread rapidly throughout the environment, causing considerable environmental damage.

It is known to stabilize these elements into a water insoluble form so that they cannot be leached from the contaminated waste into the environment. Existing methods have achieved limited success and the present invention seeks to improve on these existing methods.

SUMMARY OF THE INVENTION

Accordingly, the present invention provides a process for treating contaminated waste to stabilize environmentally harmful heavy metal comprising (a) contacting the contaminated waste with a mixture of (i) a sulfide selected from the group consisting of calcium sulfide, calcium polysulfide, sodium sulfide, sodium hydrosulfide and iron sulfide, (ii) calcium phosphate to prevent oxidation of the sulfide and (iii) calcium carbonate and (b) adding water to enhance mass transfer during mixing.

The calcium phosphate is added to prevent re-mobilization of the contaminating metals by precipitating any available ferric iron so that the redox potential is insufficient to oxidize metallic sulfide. The calcium phosphate is preferably used in the amount of 1 to 3% by weight of the contaminated waste. The preferred calcium phosphate is calcium hydrogen phosphate.

The calcium carbonate acts as a basic compound and may be supplemented by calcium oxide. The base component is used in an amount sufficient to provide two or more times the amount of neutralization capability as there is acid generation potential from the added sulfide. That is the addition of calcium carbonate (and, if present, the calcium oxide) provides an additional safety measure by supplying in excess of 2 parts neutralization potential for each part of maximum potential acidity. The calcium carbonate is preferably fine, that is of small particle size. The base component is used to ensure that the final pH of the treated waste is greater than about 8.5.

The sulfide is preferably used in an amount of 1 to 12% by weight of the contaminated waste, the actual amount depending on the concentration of contaminant present. The sulfide, calcium phosphate, calcium carbonate and, if present, the calcium oxide, are mixed prior to use.

The addition of the base (calcium carbonate and, perhaps, calcium oxide) and the calcium phosphate increases the pH of the treated waste to prevent the generation of hydrogen sulfide.

The invention is illustrated in the following example:

EXAMPLE

Soil samples were prepared and treated by the process according to the present invention and compared to untreated samples. The treated and untreated samples were subjected to the Toxicity Characteristic Leaching Procedure (TCLP) as described in "Hazardous Waste Management System; Identification and Listing of Hazardous Waste; Toxicity Characteristics Revisions; Final Rule. Environmental Protection Agency, Federal Register. Part II. 40 CFR Part 261 et al. Mar. 29, 1990. The following results were achieved:

TABLE 1

| Waste Source | Contaminant Metal | Untreated TCLP (mg/L) | Treated TCLP (mg/L) | Criteria for Safe Disposal (mg/L) |
|---|---|---|---|---|
| Auto Re-cycler soil | Lead | 55 | <0.10 | 5 |
| Pickling Sludge | Lead | 650 | 0.74 | 5 |
| Foundry Soil | Lead | 400 | <0.05 | 5 |

Although it is known from the prior art that sulfide alone can be used to stabilize toxic metals in contaminated waste, the problem with the use of sulfide alone is concern for subsequent oxidation of the sulfide and generation of acid which re-mobilizes contaminant metals—see Conner, Jesse R., "Chemical Fixation and Solidification of Hazardous Wastes", Van Nostrand Reinhold, New York, N.Y. Library of Congress TD1060.C66 1990. p 83. The process of the invention mitigates this concern for the reactivity of the metallic sulfides which occurs by the reaction with ferric iron. The process of the present invention incorporates phosphate which precipitates any available ferric iron so that the redox potential is insufficient to oxidize metallic sulfide—see Renton J.J. et al., "The use of Phosphate Materials as Ameliorants for Acid Mine Drainage", Inf. Cir—US Bur. of Mines, 1988 Number IC 9183, Mine Drain. Surf. Mine Reclam., Vol. 1 pp 67–75 and Stiller A.H. et al., "An Experimental Evaluation of the Use of Rock Phosphate (Apatite) for the Amelioration of Acid-Producing Coal Mine Waste", Mining Science & Technology v9 n3 Nov. 1989 pp. 283–287.

Although the forgoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A process for treating contaminated solid waste containing leachable, toxic, environmentally harmful heavy metals comprising:

(a) contacting the contaminated solid waste with a mixture comprising: (i) a sulfide selected from the group consisting of calcium sulfide, calcium polysulfide, sodium sulfide, and sodium hydrosulfide, said sulfide being in an amount between about 1% to about 12% of the weight of the contaminated solid waste, (ii) a calcium phosphate, and (iii) calcium carbonate; and (b) adding water to enhance mass transfer during mixing; wherein said heavy metal is stabilized sufficient to pass the TCLP.

2. The process of claim 1, wherein the sulfide is calcium sulfide.

3. The process of claim 1, wherein the leachable toxic environmentally harmful heavy metal is lead.

4. The process of claim 1, wherein the calcium phosphate is calcium hydrogen phosphate.

5. The process of claim 1, further comprising the step of mixing the components of the mixture prior to contacting the contaminated solid waste with the mixture.

6. The process of claim 1, further comprising the step of adding water to the contaminated solid waste or to the mixture.

7. The process of claim 1, wherein the contaminated solid waste further comprises ferric iron, and wherein the step of contacting the contaminated solid waste with the mixture further comprises precipitating the ferric iron as a phosphate.

8. The process of claim 1, wherein the step of adjusting the quantity and composition of the mixture is carried out so that the concentration of the calcium phosphate is brought to about 1% to about 3% by weight of the contaminated solid waste.

9. The process of claim 8, wherein the sulfide is calcium sulfide.

10. The process of claim 1, wherein the contaminated solid waste is soil.

11. The process of claim 10, wherein the leachable, toxic, environmentally harmful heavy metal is lead.

* * * * *